US006062995A

United States Patent [19]

Murphy et al.

[11] Patent Number: 6,062,995

[45] Date of Patent: May 16, 2000

[54] JOINT ASSEMBLY COMPRISING A DEFORMING ELEMENT

[75] Inventors: Stephen Duncan Murphy, Montreal; Terrance William Sutherland, Gloucester, both of Canada

[73] Assignee: Bauer, Inc., Montreal, Canada

[21] Appl. No.: 09/043,808

[22] PCT Filed: Sep. 26, 1996

[86] PCT No.: PCT/CA96/00649

§ 371 Date: Jul. 20, 1998

§ 102(e) Date: Jul. 20, 1998

[87] PCT Pub. No.: WO97/11755

PCT Pub. Date: Apr. 3, 1997

Related U.S. Application Data

[60] Provisional application No. 60/004,319, Sep. 26, 1995.

[51] Int. Cl.[7] ..... A63B 59/14

[52] U.S. Cl. ..... 473/562; 473/563

[58] Field of Search ..... 473/566, 567, 473/562, 563, 307, 313

[56] References Cited

U.S. PATENT DOCUMENTS

| | | | |
|---|---|---|---|
| 3,638,942 | 2/1972 | Bassett . | |
| 3,735,473 | 5/1973 | Wilson | 473/566 |
| 3,877,698 | 4/1975 | Volpe . | |
| 4,963,051 | 10/1990 | Hutter . | |
| 5,628,509 | 5/1997 | Christian | 473/307 |
| 5,785,617 | 7/1998 | MacKay | 473/566 |

FOREIGN PATENT DOCUMENTS

| | | |
|---|---|---|
| 2 649 152 | 1/1991 | France . |
| 1 383 949 | 2/1975 | United Kingdom . |

*Primary Examiner*—Mark S. Graham
*Attorney, Agent, or Firm*—Ratner & Prestia

[57] ABSTRACT

The invention relates to an improved joint assembly comprising a deforming element that is compressed to secure a first member into the recess of a second member. Preferably the deforming element comprises angular projections and is made from a relatively soft material which allows for its deformation. The joint of the invention has the advantage of not requiring any heat or tool and is particularly useful for attaching a hockey stick blade to a hockey stick handle without the need of adhesives or other types of mechanical connectors. The invention also relates to a hockey stick blade and to a hockey stick incorporating the deforming element of the present invention.

12 Claims, 5 Drawing Sheets

JOINT ASSEMBLY COMPRISING A DEFORMING ELEMENT

This application claims the benefit of U.S. Provisional Application No. 60/004,319 filed Sep. 26, 1995.

FIELD OF THE INVENTION

The present invention relates to an improved joint assembly comprising a deforming element that is particularly useful for attaching a hockey stick blade to a hockey stick handle. The invention also relates to a hockey stick blade and to a hockey stick incorporating the joint assembly of the present invention.

BACKGROUND TO THE INVENTION

For quite some time, manufacturers of hockey equipment have been offering alternatives to the traditional wooden stick by offering hockey sticks in which the blade and the handle are separate components that may be secured to one another by the player. These sticks commonly comprise a blade, made from traditional materials such as wood, reinforced with carbon fibres or glass fibres, and a shaft commonly made from aluminium. These sticks have the advantages of exhibiting the required amount of stiffness while keeping the "wood-like" feel to which the players are accustomed. Since the failure of a stick usually occurs at the blade, such hockey sticks are also relatively cheaper to own in the long run since, upon breakage, the player only has to replace the wooden blade that can be purchased at a lower price than a complete wooden stick.

Another advantage to having removable blades is that the player is capable of adapting his stick to the surface of play. This has been particularly advantageous in recent years with the advent of in-line roller skates and roller hockey. Since roller hockey is played on a surface which is harsher than ice, a player practising such sport requires a blade whose abrasion and wear properties differ from traditional ice hockey blades. Removable blades thus allow a player to keep his or her favourite handle and simply replace the blade to accommodate the different surfaces of play.

In order to secure a hockey blade to a hockey stick, many manufacturers are providing replacement blades comprising hot-melt adhesives or other thermo bonding materials. To replace the blade, the player, or the person responsible for the player's equipment, must first heat the portion of the handle that is adapted to receive the blade so as to soften or melt the adhesive thereby permitting the removal of the old blade which can then be discarded. The new blade is then inserted in place in the handle and the joint heated again. The blade/handle combination is then left to cool down to permit the adhesive to set. The type of appliance commonly used to provide the required amount of heat range from the common household hair dryer to the more powerful and faster hot air guns and torches, the latter ones being preferred because of their capacity to quickly generate the necessary amount of heat.

Apart from the inherent danger associated with fire, these types of joints possess many disadvantages including the necessity to carry additional equipment such as a hair dryer or a torch. Another important inconvenient is that these types of joints are not adapted to be used with sticks made from materials other than metal. Indeed, hockey stick handles made from composite materials have limited heat tolerance and may structurally deteriorate in the area of the joint when subjected to heat.

In view of this, other manufacturers have suggested using various types of mechanical connectors such as locking pins or screws. However, these types of joints also have various disadvantages, including the necessity of carrying the required tools. Another important disadvantage is that apertures must usually be performed across the handle to receive these screws or pins. Such apertures may weaken the structural integrity of the handle and increase the manufacturing costs of the stick.

OBJECTS AND STATEMENT OF THE INVENTION

It is therefore an object of the present invention to provide a joint assembly particularly useful for use with a sport stick.

It is a further object of the invention to provide a removable hockey stick blade that may be retrofitted to conventional hockey stick handles.

It is a further object of the present invention to provide a hockey stick comprising a removable blade which does not require any heating or tools to be assembled or disassembled with the handle.

As embodied and broadly described herein, the invention provides a sporting implement including:

- a first member;
- a second member;
- a joint removably securing said first member to said second member, said joint including:
  - a recess formed on one of said members;
  - a projection formed on the other of said members, said projection being capable of being received in said recess;
  - a fastener between said projection and an inner wall of said recess, said fastener being resiliently deformable upon insertion of said projection in said recess and being capable of establishing in response to the resilient deformation a condition of frictional lock between said projection and an inner wall of said recess.

For the purposes of this specification the expression "resiliently deformable" refers to the ability of a body to recover its size and form, at least partially, following deformation. This definition does not imply that the body must recover fully to its original shape and size when the deformation effort is removed. Rather, the definition intends to specifically encompass situations where the shape and size recovery its only partial. Also, the expression "frictional lock" refers to a condition in which the fastener generates sufficient frictional force against the inner wall of the recess, the projection or both, to prevent or at least substantially reduce the likelihood of separation of the joint under normal efforts encountered when the sporting implement is being used.

In a preferred embodiment, the sporting implement is a hockey stick, the novel joint being used for securing a blade member provided with the projection to a handle member having the recess in which the projection is inserted. The fastener comprises a resilient block having at least one protuberance, such as a tooth extending angularly away from the direction of insertion of the projection into the recess. This feature donates to the fastener an unidirectional locking capability that is manifested when one attempts to remove the projection from the recess. When the projection is inserted in the recess the tooth-like protuberance yields away thus permitting to assemble the joint by applying reasonable compressive force. However, when one attempts to separate the joint the frictional force generated against the surface of the toot-like protuberance acts in a way to further wedge it between the projection and the recess wall, thus resisting separation. In a most preferred embodiment, the fastener is permanently attached to the blade member.

As embodied and broadly described herein, the invention also provides a hockey stick blade comprising a shaft portion for insertion into a recess of a hockey stick handle, said shaft portion including a fastener, said fastener being resiliently deformable upon insertion of said shaft portion in the recess and being capable of establishing in response to the resilient deformation a condition of frictional lock between said projection and an inner wall of said recess.

In yet another embodiment, the invention provides a hockey stick comprising:

a handle having a first end and a second end, said handle including a recess at said first end;

a blade comprising a shaft portion for insertion into said recess;

a fastener between said shaft portion and an inner wall of said recess, said fastener being resiliently deformable upon insertion of said shaft portion in said recess and being capable of establishing in response to the resilient deformation a condition of frictional lock between said shaft portion and an inner wall of said recess.

In a preferred embodiment, the shaft portion is generally rectangular and the fastener includes a pair of resilient blocks mounted on opposite sides of the shaft portion. Most preferably, the resilient block has a durometer hardness less than about 73A and includes three tooth-like protuberances extending angularly in a direction away from the direction of insertion of the blade into the handle. Other preferred features include providing a resilient block having an offset of at least 1.0 mm (0.04 inch) from the walls of the shaft and tooth-like protuberances that extends at an angle of approximately 60°.

As embodied and broadly described herein the invention further provides a fastener for securing a hockey stick blade member to a hockey handle blade member, one of the members including a recess and the other of the members including a projection capable of insertion in the recess, said fastener being resiliently deformable upon insertion of the projection in the recess and being capable of establishing in response to the resilient deformation a condition of frictional lock between the projection and an inner wall of the recess.

Other objects and features of the invention will become apparent by reference to the following specification and to the drawings.

BRIEF DESCRIPTION OF THE DRAWINGS

The following is a description by way of a preferred embodiment, reference being made to the following drawings, in which.

DESCRIPTION OF A PREFERRED EMBODIMENT

Figures 1, 2, 3:
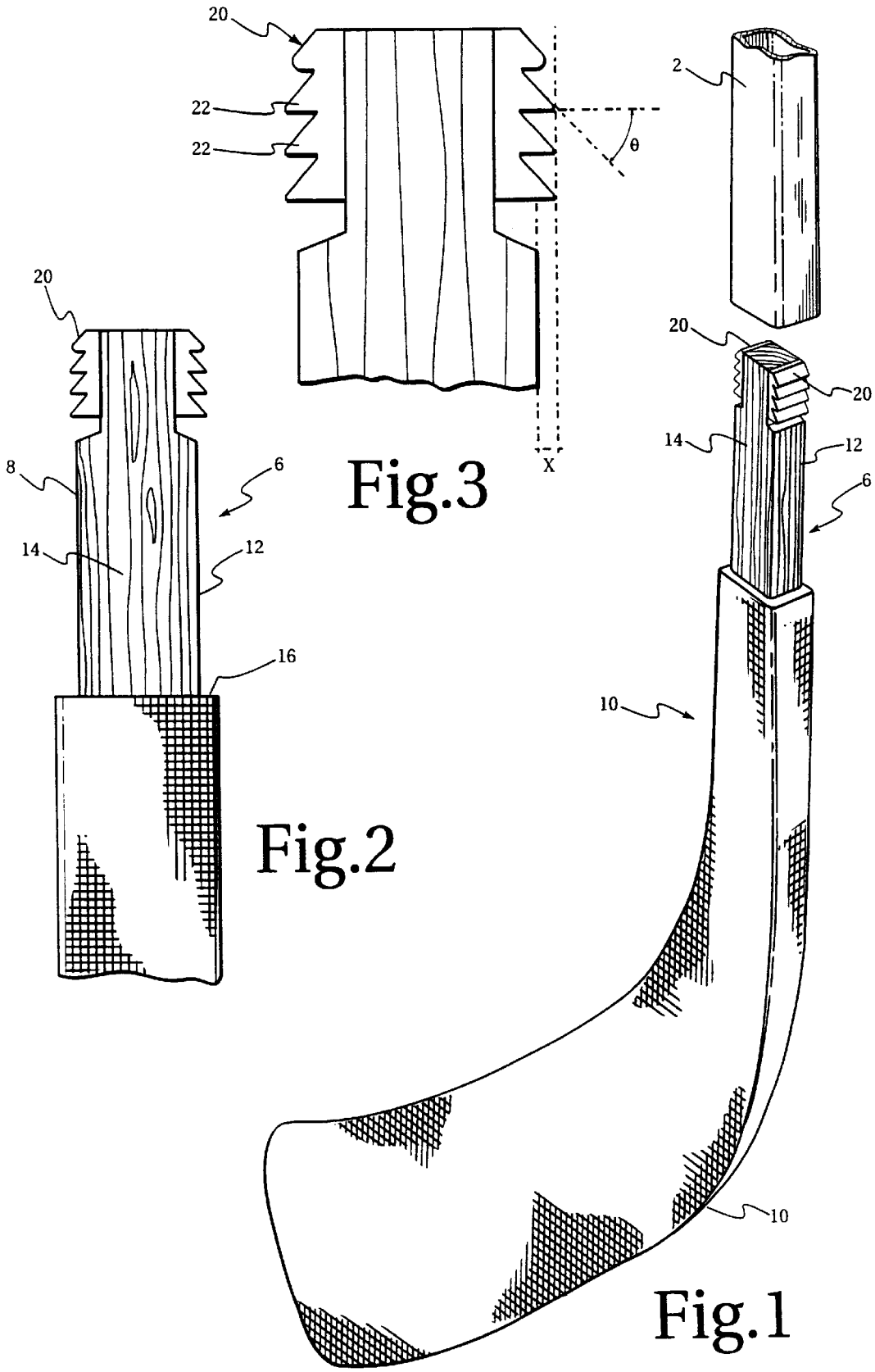
FIG. 1 is a perspective view illustrating a portion of a handle and a hockey stick blade comprising a joint assembly according to the present invention.
FIG. 2 is an enlarged side elevational view illustrating a portion of a shaft formed on the hockey stick blade, comprising a friction fastener according to the invention.
FIG. 3 is a further enlarged side elevational view of the friction fastener according to the invention.

Referring to FIG. 1, there is shown a hockey stick comprising an elongated handle 2 and a blade generally referred to at 10.

The handle 2 may be made from a metallic material such as aluminium or may be manufactured from a variety of composite materials such as carbon fibres, glass fibres, Kevlar or the like. It is preferably of rectangular shape or may comprise convex and concave side walls to improve the grip of the player. Since it does not require any heating, the joint assembly of the present invention may be used with many types of hockey stick handle including ones made from composite material and is therefore not limited to any particular type of handle. The only structural requirement of the handle is that it comprises a recess 3 (FIG. 4) at one end thereof for receiving a shaft portion 6 of the blade 10.

The blade 10 comprises a bottom edge 4 for contacting a surface of play and also comprises a shaft portion 6 preferably having a generally rectangular cross section comprising a front wall 8, a rear wall 12 and wider side walls 14. In the preferred embodiment, the front and rear walls 8, 12 are approximately 15.5 to 15.7 mm (0.612 to 0.617 inch) wide while the side walls 14 are approximately 25.9 to 26.0 mm (1.023 to 1.027 inch) wide. The shaft portion 6 has a length of approximately 76.2 mm (3 inches).

The shaft portion 6 of the blade closely conforms with the shape of the recess 3 so that there is little free play once the shaft portion of the blade is inserted into the recess 3. The blade also preferably comprises a shoulder 16 that will abut against the end portion of the handle 17 upon telescopic engagement of the blade into the recess 3 as described hereinafter. Furthermore, the dimensions of the shaft portion and of the blade are such that the outside walls of the blade will be flush with the outside walls of the handle when the shaft portion is inserted into the recess.

Figure 4:
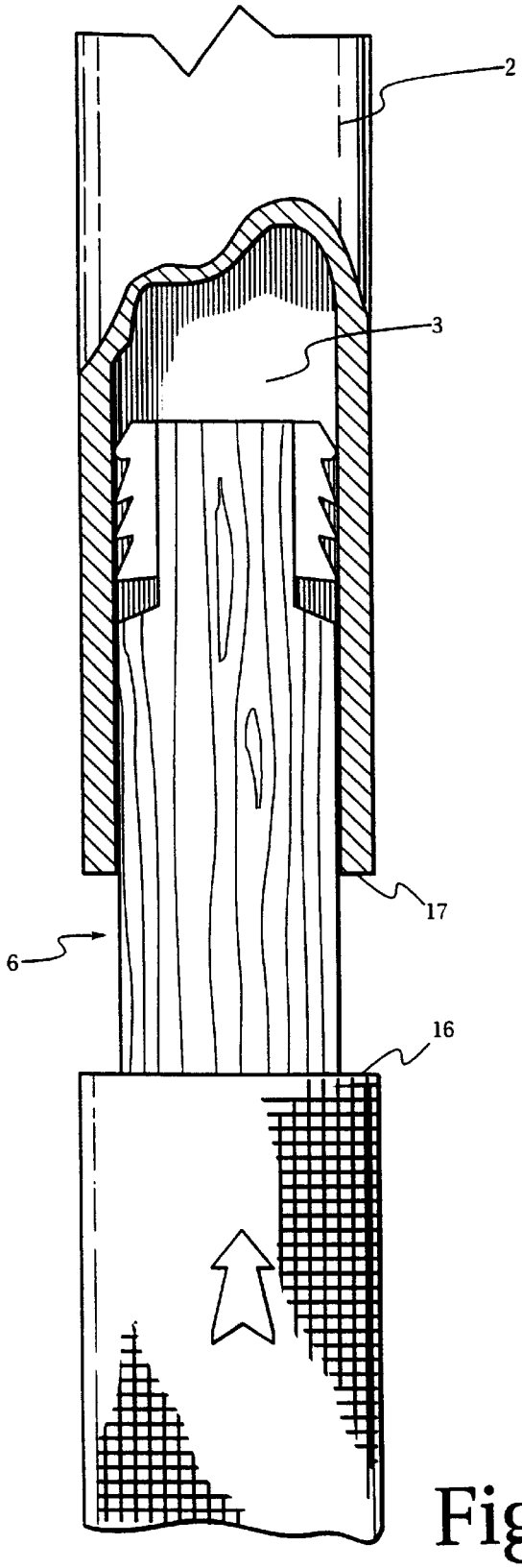
FIG. 4 is a fragmentary view of a hockey stick blade with the friction fastener according to the present invention, illustrating the insertion of the blade in the handle performed to assemble the hockey stick.

As shown more particularly in FIG. 3, the shaft portion 6 comprises a friction fastener including at least one resilient block 20 having a plurality of tooth-like protuberances 22 that extend angularly in a direction away from the direction of insertion of the shaft portion 6 into the recess 3(the direction of insertion is shown by the arrow in FIG. 4). In the preferred embodiment, the angle θ of each tooth-like protuberance is approximately 60° although it may vary as described hereinafter. In order to detachably secure the blade to the handle, the tooth-like protuberances 22 of the resilient block 20 extend beyond the plane of the walls of the shaft portion. In the preferred embodiment, the projection height x' of the tooth-like protuberances, is of at least 1.0 mm (0.04 inch). In the most preferred embodiment, the resilient block is approximately 16.7 mm (0.660 inch) long but the length may vary to suit the player's preference. The desired projection height is arrived at by forming on the surface of the shaft portion 6 on which the resilient block is placed a recess 30 whose depth determines the value x'.

Figure 4A:
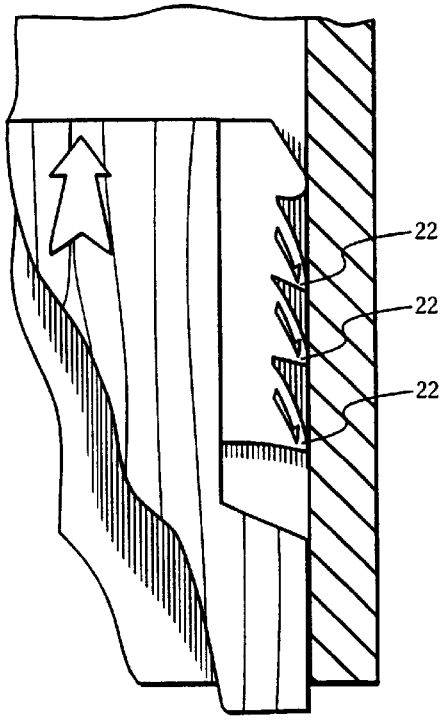
FIG. 4*a* is a fragmentary further enlarged view of the hockey stick blade with the friction fastener according to the present invention, illustrating the resilient deformation to which the fastener is subjected when the blade is inserted into the handle.

Referring now to FIG. 4, in order to detachably secure the blade 10 to the stick handle 2, the user simply inserts the shaft portion 6 into the recess 3 of the handle and exerts the required amount of force until the shaft portion is completely inserted into the handle, i.e. until the shoulder 16 abuts against the end portion 17 of the handle. As shown more particularly in FIG. 4*a,* during insertion of the blade, the tooth-like protuberances 22 of the deforming element 20 will resiliently deform and yield inwardly ("inwardly" means toward the shaft portion 6) and be compressed against the inner wall of the handle. The angular orientation of the tooth-like protuberances will facilitate their inward yielding and as a result, the amount of force required to insert the blade into the handle will be substantially less than the amount of force required to remove it.

Figure 5:
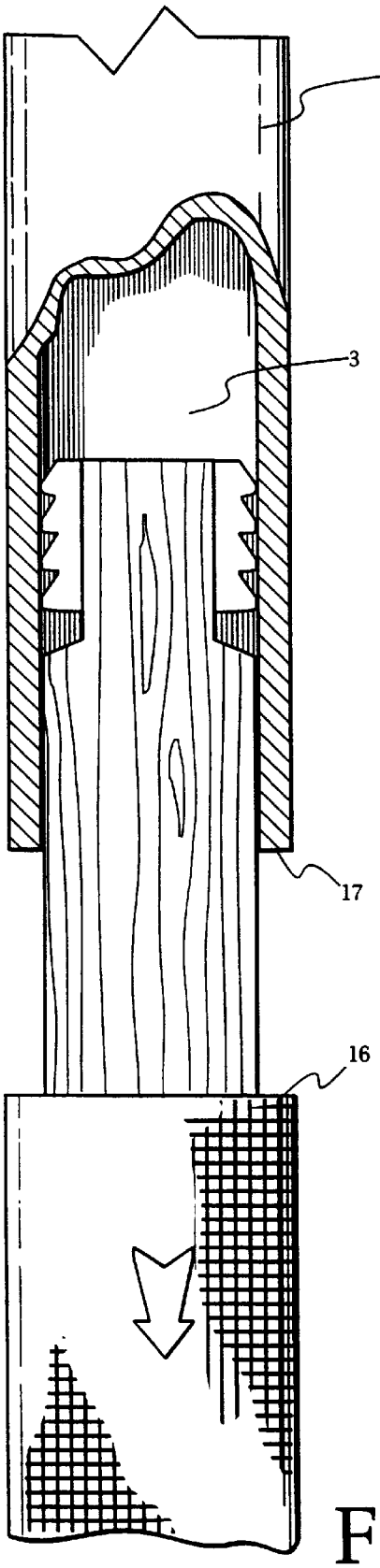
FIG. 5 is a fragmentary view of a hockey stick blade with the friction fastener according to the present invention, illustrating the removal of the blade from the handle.
Figure 5A:
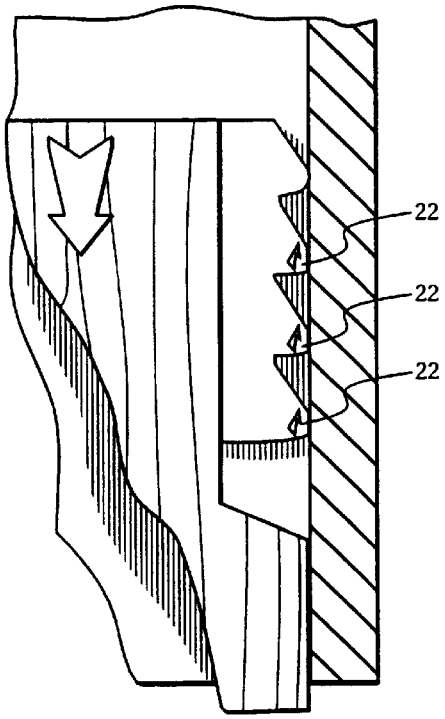
FIG. 5*a* is a fragmentary further enlarged view of the hockey stick blade with the friction fastener according to the present invention, illustrating the wedging effect on the fastener tooth-like protuberances that occurs when the blade is removed from the handle.

Because the block 20 is made of resilient material, once inserted in the recess 3, the tooth-like protuberances 22 will generate contact friction against the inner wall of the recess 3 and will prevent the blade from disengaging from the handle. As shown in FIG. 5, when the user desires to remove the blade, he or she will simply pull on the blade or the handle in a direction opposite the direction of insertion. However, as shown more particularly in FIG. 5*a*, because of the angular orientation of the projections, they will have a tendency to roll back and wedge themselves between the inner wall of the recess 3 and the shaft portion 6, thus resisting removal. The amount of force required to remove the blade will thus be significantly greater than the amount of force required to insert the blade. In a preferred embodiment, the deforming element will be configured so a to provide a removal load of approximately 25 to 35 kg.

EXAMPLES

The following examples have been tested and have provided satisfactory results. The examples used are as illustrated in FIG. 2 and consist of a blade having a shaft portion comprising a friction fastener that includes two resilient blocks, each block being approximately 16.7 mm (0.660 inch) long, bonded to the uppermost portion of each of the front and rear walls 8 and 12. Each resilient block comprises three tooth-like protuberances extending at an angle of approximately 60°. The resilient block is made from polyurethane having a durometer hardness of approximately 73A when measured in accordance with the ASTM D-2240 test. The tested blade were inserted into the handle of a Bauer® Ergo™ stick having an internal dimension of 15.65±0.05×25.98±0.05 mm (0.616±0.002×1.023±0.002 inches).

| Ex. | shaft dimension-front or rear wall mm (inches)[1] | shaft dimension-side wall mm (inches)[1] | offset × 2 mm (inches)[1] | Maximum tensile load (kg)[2] | Plateau tensile load (kg)[3] |
|---|---|---|---|---|---|
| 1 | 15,49 (.610) | 26,04 (1.025) | 2,67 (.105) | 25 | 19 |
| 2 | 15,49 (.610) | 26,04 (1.025) | 2,77 (.109) | 36 | 28 |
| 3 | 15,49 (.610) | 26,04 (1.025) | 2,87 (.113) | 39 | 30 |
| 4 | 15,49 (.610) | 26,04 (1.025) | 1,91 (.075) | 29 | 23 |
| 5 | 15,49 (.610) | 26,09 (1.027) | 1,91 (.075) | 35 | 29 |

-continued

| Ex. | shaft dimension-front or rear wall mm (inches)[1] | shaft dimension-side wall mm (inches)[1] | offset × 2 mm (inches)[1] | Maximum tensile load (kg)[2] | Plateau tensile load (kg)[3] |
|---|---|---|---|---|---|
| 6 | 15,54 (.612) | 25,98 (1.023) | 1,91 (.075) | 34 | 30 |
| 7 | 15,62 (.615) | 25,98 (1.023) | 1,91 (.075) | 40 | 32 |
| 8 | 15,62 (.615) | 26,04 (1.025) | 1,35 (.053) | 34 | 21 |
| 9 | 15,62 (.615) | 26,04 (1.025) | 1,52 (.060) | 35 | 22 |
| 10 | 15,62 (.615) | 26,04 (1.025) | 1,73 (.068) | 46 | 28 |
| 11 | 15,62 (.615) | 26,04 (1.025) | 1,91 (.075) | 49 | 33 |
| 12 | 15,62 (.615) | 26,09 (1.027) | 1,91 (.075) | 50 | 35 |

[1]The dimensions were all measured in inches and later converted into mm based on the following equation (1 inch = 25,4 mm).
[2]The maximum tensile load may be defined as the maximal force required to remove the blade from the handle, this maximum force usually occurring during the initial effort. It was recorded using a dynamometer.
[3]The plateau tensile load may be defined as the average or constant force required to remove the blade from the handle. It was also recorded using a dynamometer.
While some of the shaft dimension listed are larger than the actual internal dimension of the handle, an expansion of the latter compensates for any difference in size.

The purpose of the conducted test was to determine the parameters required to provide a removal load, i.e. the force required to remove the blade, of between 25 to 35 kg.

The sticks described above all provided satisfactory results, namely a suitable removal force and no free play of the shaft within the recess.

Other materials having different properties could of course be used to accommodate the conditions of play and the users' preferences. For example, the resilient block used in an ice hocky blade which normally is subjected to sub-zero temperatures may not require the same hardness as one used by a roller hockey player in a warm environment. Similarly, a younger player that isn't physically very strong may not require the same type of blade and removal load as the professional player. All the various parameters that may affect strength of the joint assembly, including the type and hardness of the material, the offset, the angle and the amount of tooth-like protuberances, and the size of the resilient block may be modified to take into consideration these various conditions.

For example, the type of material used is not restricted to polyurethane but may comprise any type of resilient material capable of providing a satisfactory joint. These types of materials may be determined by routine testing. Furthermore, in a less preferred embodiment, the resilient block could be made from a material that would allow the projections to deform and be compressed enough to secure the blade to the handle but that would structurally fail upon removal of the blade. Such a type of sacrificial friction fastener would be satisfactory for blades that need to be discarded after a single removal.

With regard to the offset (value x'), it will vary depending on the size of the shaft portion relative to the recess of the handle and will also depend upon the amount of free play present in the joint assembly, the object being to keep the free play at a minimum. Thus, as shown by the above described examples, a smaller shaft, such as example 1, will accommodate a higher offset than a larger shaft, such as example 9, and will require a similar removal load. Similarly, shafts of identical dimensions with offsets of different values will exhibit different removal loads, the higher offset requiring the biggest removal load (compare example 1 with examples 2 and 3).

The angle of the tooth-like protuberances may also be modified to change the amount of force required to insert the blade compared with the amount of force required to remove it (removal load). The preferred embodiments described herein have the advantage of providing a joint assembly whereby the amount of force required to insert the blade is smaller than the amount of force required to remove same. However, it is possible to conceive a joint assembly that does not comprise any tooth-like protuberances or that comprise tooth-like protuberances extending at an angle of 90° so that the force required to insert the blade will be approximately the same as the force required to remove it. Although not optimal, such an embodiment is possible.

The number of tooth-like protuberances could also be modified to achieve the desired removal load. In test conducted using the examples described above, it has been found that the removal of a tooth-like protuberance decreases the removal force by approximately 10%.

Figure 6:
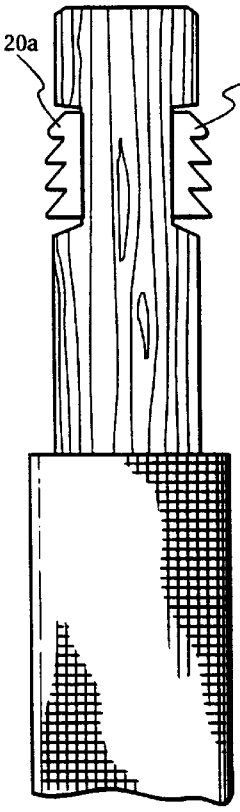
FIGS. 6 to 9 are side elevational views illustrating variants of the friction fastener according to the present invention.
Figure 7:
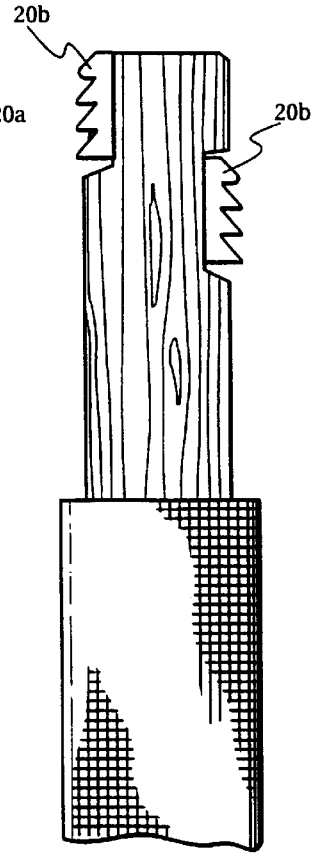
Figure 8:
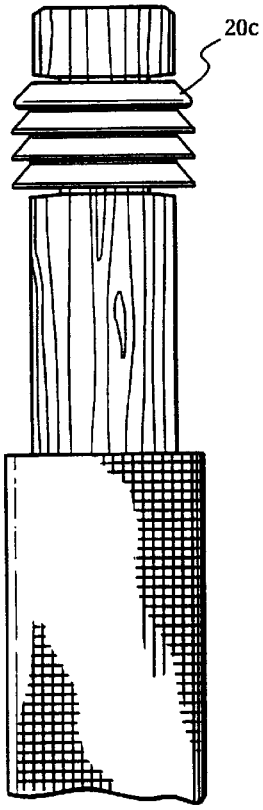
Figure 9:
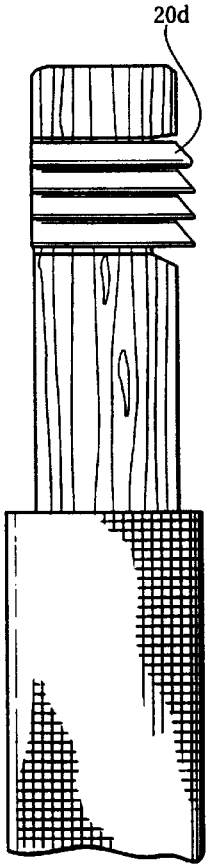
Figure 9A:
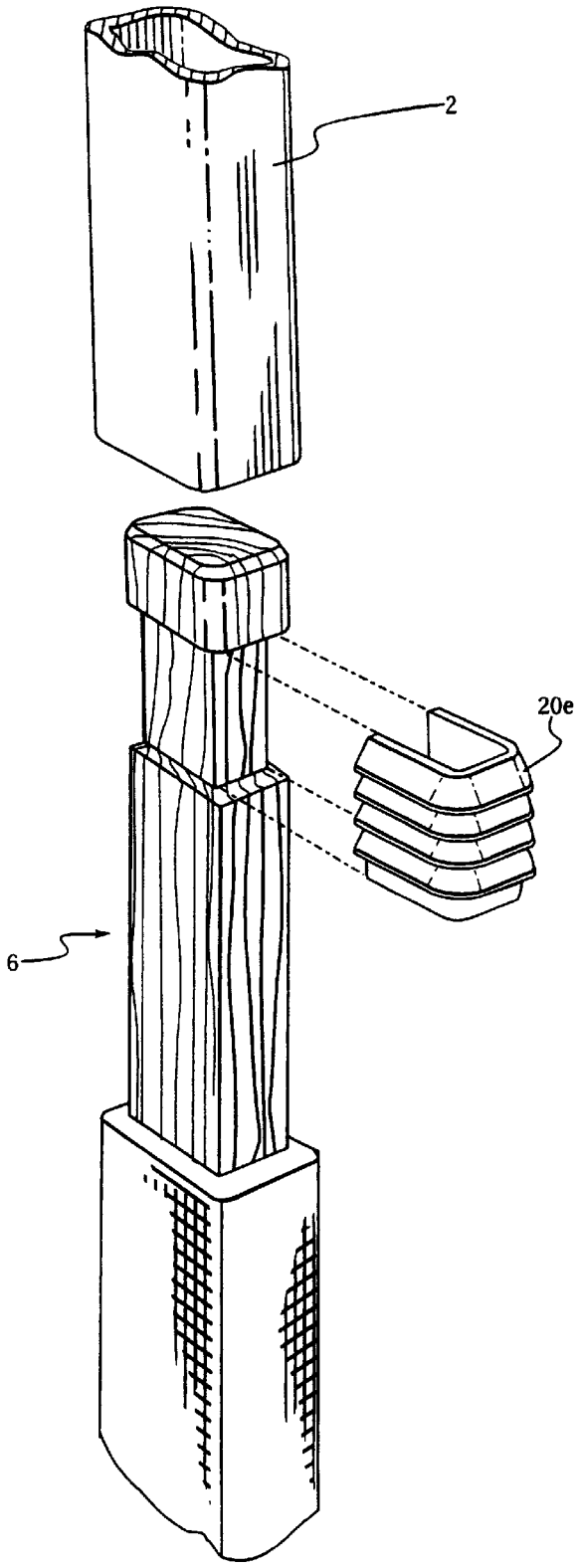
FIG. 9*a* is an exploded view of the embodiment of the friction fastener illustrated at FIG. 9.

FIGS. 6 to 9*a* illustrate other embodiments of the invention. As shown in FIG. 6, the resilient blocks 20*a* may be located at an area other than the uppermost portion of the shaft or may not be opposite one another as shown at 20*b* in FIG. 7. Referring now more specifically to FIGS. 8 and 9, there is shown embodiments in which resilient blocks are provided on three of the walls of the shaft, such as on the front and rear walls and on a side wall (see 20*c* in FIG. 8) or on each of the side walls and on the front or rear wall (see 20*d* in FIG. 9). Other combinations are possible including the possibility of providing a resilient block on each of the walls of the shaft portion. FIG. 9*a* shows yet another embodiment in which the resilient block 20*e* is not bonded to the shaft but is slidingly received on same. More specifically, the resilient block is made as a U-shaped part, the tooth-like protuberances being continuous and extending on all three walls of the U-shaped part. The recess formed by the U-shaped part is configured to receive a narrowed segment of the shaft like portion 6, both components being retained to one another by friction. This embodiment allows the resilient block to be removed easily and replaced by a fresh one.

In another embodiment, the joint assembly of the present invention could be used to detachably secure a grip member to the end of the handle opposite the blade receiving end. In such an embodiment, the grip member could be provided with a deforming element according to the present invention and could be inserted into a recess of the handle.

The above description of the preferred embodiments should not be interpreted in any limiting manner since variations and refinements are possible which are within the spirit and scope of the present invention. The scope of the invention is defined in the appended claims and their equivalents.

What is claimed is:

1. A hockey stick comprising:

a blade;

a handle; and a joint removably securing said blade to said handle, said joint including:

(a) a recess having an inner wall formed on one of said handle or said blade, (b) a projection formed on the other one of said handle or said blade, said projection adapted to be received in said recess along a direction of insertion, and (c) a fastener disposed between said projection and said inner wall of said recess, said fastener having a longitudinal axis and at least one resiliently deformable tooth-like protuberance adapted to frictionally engage said projection to said recess, said at least one resiliently deformable tooth-like protuberance extending away from the direction of insertion of said projection in said recess and having a shape and orientation such that the required force to remove said blade from said handle is greater than the required force to secure said blade to said handle.

2. The hockey stick according to claim 1, wherein said tooth-like protuberance is oriented at an angle different from 90 degrees with relation to said direction of insertion.

3. The hockey stick according to claim 1, wherein said tooth-like protuberance is oriented at an angle of approximately 60 degrees with relation to said direction of insertion.

4. The hockey stick according to claim 1, wherein said tooth-like protuberance has a durometer hardness less than about 73A.

5. The hockey stick according to claim 1, wherein said fastener has three tooth-like protuberances.

6. The hockey stick as defined in claim 1 wherein said projection has a shape and dimension that closely conforms with the shape of said recess.

7. The hockey stick as defined in claim 1 wherein said at least one resiliently deformable tooth-like protuberance extends beyond a plane defined by said inner wall of said recess.

8. A replacement blade for a hockey stick comprising:

a bottom portion adapted to contact a surface of play;

a shaft portion integrally connected to said bottom portion, said shaft portion being of generally rectangular cross section and having a projection of reduced rectangular cross section comprising a front wall, a rear wall, and wider side walls, said projection adapted to be inserted in a recess of a hockey stick handle;

a shoulder defined by said projection and adapted to abut against an end portion of a hockey stick handle; and a fastener secured to one end of said projection, said fastener including at least one resilient block having a plurality of deformable tooth-like protuberances that extend angularly towards said bottom portion.

9. The hockey stick blade as defined in claim 8 wherein said tooth-like protuberances of said at least one resilient block extend beyond a plane defined by said walls of said projection.

10. The hockey stick blade as defined in claim 9 wherein said tooth-like protuberances are oriented at an angle of approximately 60 degrees with relation to a longitudinal axis of said projection.

11. The hockey stick blade as defined in claim 9 wherein said tooth-like protuberances have a durometer hardness less than about 73A.

12. The hockey stick blade as defined in claim 9 wherein said at least one resilient block has three tooth-like protuberances.

* * * * *